United States Patent [19]

Davis

[11] 4,246,669

[45] Jan. 27, 1981

[54] DUAL BELT PULP WASHER

[75] Inventor: Steven S. Davis, Bountiful, Utah

[73] Assignee: Envirotech Corporation, Menlo Park, Calif.

[21] Appl. No.: 951,540

[22] Filed: Oct. 16, 1978

Related U.S. Application Data

[63] Continuation of Ser. No. 853,068, Nov. 21, 1977, Pat. No. 4,160,297.

[51] Int. Cl.[3] ..... D06B 5/04; D21C/9/06

[52] U.S. Cl. ..... 8/156; 68/19; 68/44; 68/158; 68/181 R; 68/208; 68/DIG. 5

[58] Field of Search ..... 8/156; 68/DIG. 5, 27, 44, 158, 181 R, 208, 20, 19.1, 19, 45

[56] References Cited

U.S. PATENT DOCUMENTS

| | | | |
|---|---|---|---|
| 899,440 | 9/1908 | Shuman et al. | 68/44 X |
| 2,745,712 | 5/1956 | Burling et al. | 68/27 X |
| 3,834,869 | 9/1974 | Ancelle et al. | 68/44 X |
| 3,857,261 | 12/1974 | Wilcox | 68/27 X |

FOREIGN PATENT DOCUMENTS

| | | | |
|---|---|---|---|
| 2121722 | 11/1972 | Fed. Rep. of Germany | 68/45 |
| 76401 | 11/1954 | Netherlands | 68/27 |

*Primary Examiner*—Philip R. Coe
*Attorney, Agent, or Firm*—Hal Bohner; R. E. Krebs

[57] ABSTRACT

A machine and process for washing paper stock pulp and similar free-filtering materials includes two or more horizontally-disposed wash drums mounted each in a tank. Two endless filter belts are trained to pass under each of said wash drums and through liquid contained in each of the tanks. A mat of pulp is formed between the two endless filter belts and carried under each of the wash drums for washing therein. Wash liquor passes through the pulp mat as it travels under each of the drums thereby washing the pulp mat, and the liquor passes between the drums and the tanks by gravity flow. After the pulp has been washed it is removed from between the two belts.

18 Claims, 6 Drawing Figures

DUAL BELT PULP WASHER

RELATED APPLICATION

This application is a continuation of U.S. patent application Ser. No. 853,068 filed Nov. 21, 1977, and now U.S. Pat. No. 4,160,297.

BACKGROUND OF THE INVENTION

1. Field of the Invention

The present invention relates to machines for washing paper stock pulp and other free-filtering materials.

2. State of the Art

According to various processes well-known in the paper making industry, paper stock pulp is formed by digesting wood chips in the presence of various chemicals in a heated pressure vessel. After discharge from the pressure vessel, the paper stock pulp must be washed and filtered to separate the wood fibers from the digestion chemicals.

According to a conventional system for washing paper stock pulp the pulp is diluted with water after digestion and then is picked up by a large-diameter rotating cylinder whose surface is formed of a wire mesh screen. A couch roll is positioned to press downward onto the surface of the screen-covered cylinder to express liquid from the stock and thus to form a blanket or mat of dewatered fibers. Such a conventional system further includes an agitation device wherein once-dewatered fibers are repulped by mixing with water. Still further, the system includes additional agitation devices, screen-covered cylinders, and couch rolls to wash the pulp in stages.

According to other processes well-known in the paper-making industry, materials such as waste paper and ground-wood, although not digested with chemicals, must nevertheless be washed. Conventional systems for such washing are also known.

According to still other processes well-known in the paper-making industry paper pulp is bleached by treating the pulp with chemicals such as a solution of chlorine or sodium hydroxide. In other processes chemical solutions are often used to treat the pulp.

OBJECTS OF THE INVENTION

The primary object of the present invention is to provide an improved machine to wash paper stock pulp and other free-filtering materials. As will be readily understood in view of the following description, the term free-filtering encompasses materials which, when covering a filtering surface, allow liquid to pass readily there through when a slight hydraulic head is exerted. The term pulp is used herein as a synonym for free-filtering materials.

Another object of the present invention is to provide an improved machine for treating pulp with solutions of chemicals to accomplish bleaching and other processes. The term "washing" is used herein to include such treatment with chemical solutions, and the term "liquid" includes such chemical solutions.

A more specific object of the present invention is to provide an improved machine for washing pulp, which machine is of the type which operates without interstage pumps.

Yet another object of the present invention is to provide an improved machine for washing pulp which operates without repulping of the pulp stock.

Still another object of the present invention is to provide a machine for washing pulp wherein frothing of the pulp is substantially minimized.

BRIEF DESCRIPTION OF THE DRAWINGS

The above and other objects of the present invention may be readily ascertained by consideration of the following detailed description and appended drawings, which are offered by way of illustration ony and not in limitation of the invention, the scope of which is defined by the appended claims and equivalents.

In the drawings.

DETAILED DESCRIPTION OF THE INVENTION

Figure 1:
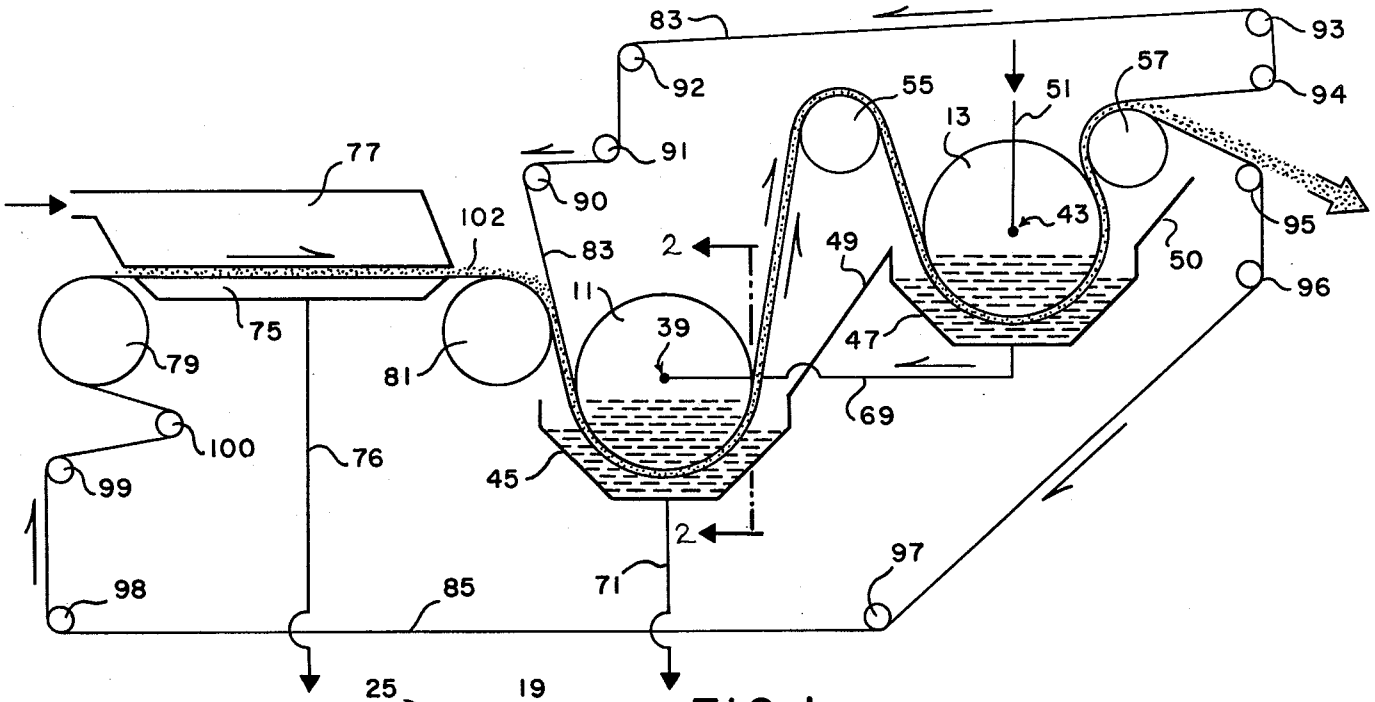
FIG. 1 is a side elevation of a machine according to the present invention shown schematically.

As shown in FIG. 1, a machine according to this invention generally includes horizontally-disposed wash drums 11 and 13 which are mounted in spaced-apart, side-by-side relationship. The wash drums are illustrated as being cylinders of equal diameter but, in certain instances, it may be desirable for the wash drums to have different diameters. The wash drums are mounted in vertically stepped relationship to one another so that the central axis of the first drum 11 is lower than the central axis of the second drum 13. The two illustrated drums are essentially the same in construction and operation and, for that reason, only one wash drum 11 will now be described in detail.

Figure 2:
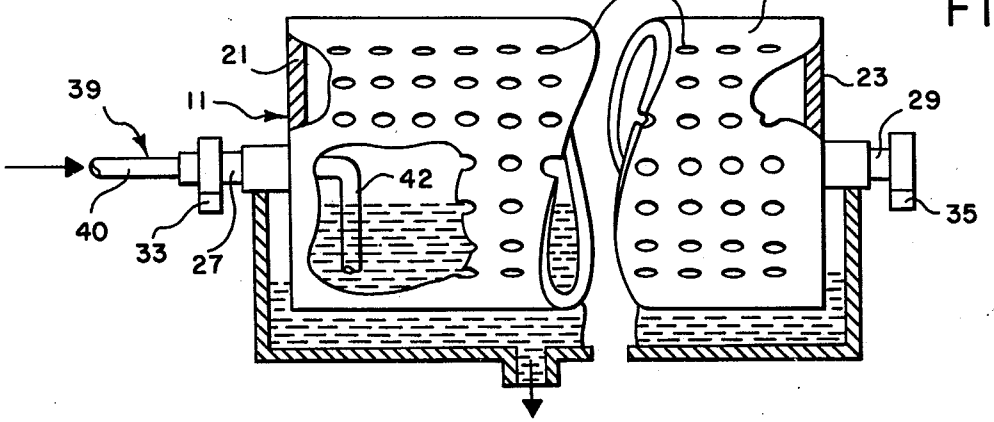
FIG. 2 is a view taken along line 2—2 in FIG. 1 for viewing in the direction of the arrows which schematically illustrates one detail of the machine of FIG. 1 partially cut away.

With reference now to FIGS. 1 and 2, the wash drum 11 includes a cylindrical sidewall 19 and end closure walls 21 and 23. The cylindrical sidewall is perforated say by small spaced-apart apertures 25 to permit liquid to flow freely from the drum. Workers skilled in this art will readily recognize that the sidewalls of the drums, instead of being perforated, could be comprised of a wedgewire grid or other conventional support means which permit liquid flow. The end closure walls 21 and 23 are nonforaminate. Axle members 27 and 29 are fixed to the end closure walls 21 and 23, respectively, and are supported for rotation outboard of the drum by stationary pillow blocks 33 and 35, respectively, or other journal means.

According to the embodiment in FIG. 2, a tube 39 is stationarily mounted to extend into the wash drum 11 to introduce liquid into its interior. The illustrated tube 39 has a horizontal section 40 which extends into the drum through the axle member 27, and a leg 42 which extends downward inside the drum.

With respect to the machine in FIG. 1, tubes 39 and 43 are mounted in communication with the interiors of wash drums 11 and 13 respectively. Tube 43 should be understood to be the same in construction and operation as the tube 39 described above.

Referring still to FIG. 1, open tanks 45 and 47 are mounted below the respective wash drums 11 and 13. The tanks are constructed and positioned to encompass the lower half or less of each of the respective wash drums and to contain a substantial quantity of liquid exterior of the wash drums. In practice, the tanks preferably are identical to one another and are mounted in vertically-stepped relationship corresponding to the differential elevations of the wash drums. A plate 49 is connected between the upper edges of tanks 45 and 47, and a second plate 50 is connected to the upper edge of tank 47 to extend upward therefrom.

A liquid inlet means, such as a conduit 51 shown in FIG. 1, is connected in communication with the tube 43 to carry wash liquor into the wash drum 13. In some applications, the wash liquor may simply be fresh water while in other instances it may be an aqueous solution of particular chemicals or a non-aqueous liquid. As will be understood in view of the following description, the flow of wash liquid is countercurrent to the direction of travel of pulp material through the machine.

Figure 3:
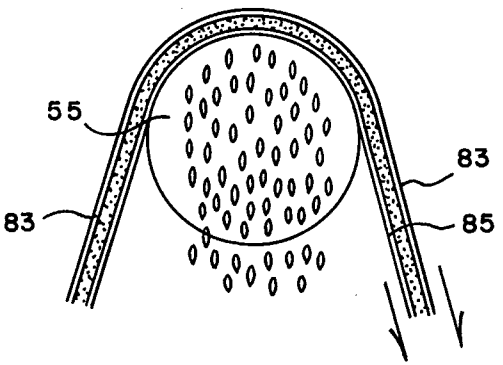
FIG. 3 shows a detail of the machine of FIG. 1 enlarged for purposes of clarity.

Referring now to FIGS. 1 and 3, a compression roller member 55 is mounted to the right and above the first wash drum and is supported for rotation by conventional means, not shown. The compression roller member 55 shown in FIG. 3 comprises, for example, a rigid hollow cylinder which is formed from wire screeen or other foraminous material so that liquid can drain freely through it. Likewise, a second compression roller member 57 is rotatably mounted to the right and above the second wash drum 13. The second roller member 57 is mounted adjacent the second drum 13 and can be adjustably positioned relative to the second drum. The second roller member 57 is the same in construction as roller member 55. However, the second roller member 57 can optionally have a rigid, non-foraminate wall.

As further shown in FIG. 1, a conduit 69 is coupled to the tank 47 to carry liquid therefrom to tube 39. A conduit 71 is connected to tank 45 to carry liquid therefrom to disposal.

The machine in FIG. 1 further includes feed means which, in the illustrated embodiment by way of example, comprises a horizontal vacuum pan 75 of conventional construction which is mounted to the left of the first wash drum 11. A conventional suction-producing device, not shown, is connected in communication with the interior of the vacuum pan to draw liquid therefrom via a conduit 76. Above the vacuum pan 75 is mounted a distribution box 77, which also is of conventional construction. At the opposite ends of the vacuum pan are rotatably mounted support rollers 79 and 81, respectively. One skilled in this art should readily recognize that the feed means could, alternatively, comprise other conventional means for forming a pulp mat between two belts. For example, the feed means could comprise a conventional vacuum drum means or a conventional system including two belts disposed substantially vertically.

Two endless filter belts 83 and 85, referred to herein as the upper and lower belts respectively, are trained around the wash drums and the compression roller members in zig-zag fashion as illustrated in FIG. 1. More particularly, the endless belts are trained in face-to-face relationship to each other to pass under each of the wash drums 11 and 13 and over each of the compression roller members 55 and 57. The endless belts should be understood to comprise conventional porous filter belts of the type which are well known in the filtration art.

Above the machine, the upper belt 83 is trained over a set of guide rollers 90–94; below the machine, the lower belt 85 is trained over a set of guide rollers 95–100. Conventional drive means, not shown, are connected to rotatably drive the roller member 57 and, thus, to cause the two endless belts 83 and 85 to travel together at equal speeds in the directions indicated by the arrows in FIG. 1. The upper and lower sets of guide rollers are positioned to separate the upper and lower belts after the belts have passed over the second compression roller member 57 and, at the opposite end of the machine, to reunite the belts in face-to-face relationship before the belts travel under the first wash drum 11. It should be further observed that the lower set of guide rollers 95–100 is positioned so that the lower belt 85 passes around the support roller 79, then between the vacuum pan 75 and the distribution box 77, and finally over the support roller 81 before reuniting with the upper belt 83. In practice, at least one guide roller in both the upper and lower sets is movably mounted so that the tensions of the belts can be selectively adjusted. Also, conventional means for laterally aligning the belts are normally provided.

The operation of the above-described machine can now be understood. Initially a free-filtering material, such as paper stock pulp containing digestion chemicals, is fed into the distribution box 77 as indicated by the arrow. That material is then discharged onto the belt 85 as it travels across the vacuum pan 75. Suction applied through the vacuum pan 75 draws liquid from the pulp, leaving a sheet or mat 102 of partially dewatered fibers lying on the belt 85. The withdrawn liquid, or filtrate, is discharged from the machine via conduit 76. The lower belt 85, after passage across the vacuum pan, meets the upper belt 83 in face-to-face relationship and, thus, the mat of pulp fibers is gripped between the two belts. Typically, the pulp mat is about one-quarter to one inch in thickness.

The two belts 83 and 85, with the pulp mat between them, then pass into the first tank 45 and under the first wash drum 11. Simultaneously the wash drum 11 is rotated, say by frictional engagement with the upper belt 83. At this time, liquid from inside the first drum 11 passes through the pulp mat between the two belts and then flows into the tank 45. This flow of liquid through the pulp mat occurs because of the differential in the hydrostatic head (liquid level) between the interior and exterior of the wash drum 11. The flow of liquid through the pulp mat serves to wash the pulp and, in some instances, also increases the moisture content of the pulp mat because some of the wash liquid is absorbed by the pulp.

The two belts 83 and 85, after passing under the wash drum 11, then pass over the first compression roller member 55. During this stage, the pulp mat is squeezed between the belts due to the tension in the upper belt 83. Liquid, which is thus expressed from the pulp, drains through the roller member 55 as shown in FIG. 3. The expressed liquor is caught by the plate 49 and flows into the tank 45.

After passage over the first compression roller member 55, the two endless belts 83 and 85 carry the pulp mat into the second tank 47 and then under the second wash drum 13. During this stage, the pulp mat undergoes a second wash like the one described above. Then, the two belts 83 and 85 with the pulp mat therebetween pass over the second compression roller member 57. Thus it can be seen that the pulp mat undergoes two stages of washing and expression. The second compression roller 57 is positioned relative to the drum 13 so that the two belts are simultaneously tangent to both the drum and the roller. The position of the roller 57 is adjusted to compress the pulp mat and express liquid therefrom.

After passing over the roller 57 the upper and lower belts 83 and 85 are moved apart by the guide rollers 94 and 95 to expose the washed pulp mat. The pulp mat is then discharged from the machine by suitable means, not shown, such as a doctor blade or the like.

As mentioned earlier, the upper and lower belts are held under predetermined tensions by the adjustable guide rollers. The tensions need not be the same. In fact, the upper belt 83 is preferably at greater tension than the lower belt 85. This causes the compressive force on the pulp mat to be greater when the mat passes over the compression rollers 55 and 57 than when it passes under the wash drums 11 and 13. This is advantageous because the pulp mat is "worked", i.e., compressed during its passage over the compression roller members and allowed to expand and absorb wash liquid when passing under the wash drums. This working can be likened to wringing a sponge and then allowing it to expand to absorb more water.

At this juncture, it should be appreciated that the flow of wash liquor through the illustrated machine is opposite to the travel of the pulp mat. More specifically, fresh water liquor is continuously fed into the second drum 13 via inlet conduit 51 at a sufficient flow rate to keep approximately the lower half of the wash drum 15 filled. Suitable control means, not shown, are preferably provided to insure that this liquor level is maintained. This fresh wash liquor, as previously described, is then forced into the tank 47 through the submerged pulp mat due to the hydrostatic head difference between the interior and exterior of the drum 13. Then, the once-used wash liquor flows from the tank 47 into the first drum 11 via the conduit 71. The liquid in the first drum 11 then is forced into the first tank 45 by the hydrostatic head in the first drum 11 and, followingly, flows to disposal via conduit 69.

It should now be apparent that a machine according to this invention can include more than two pairs of wash drums and tanks, depending upon the number of stages of washing which are required for a particular application.

Figure 6:
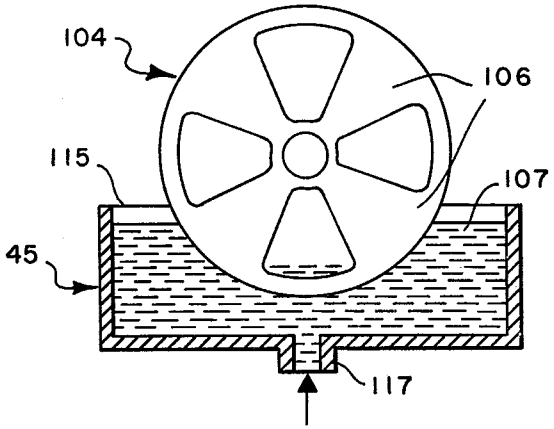
FIG. 6 shows a detail of the machine of FIG. 4.

An embodiment of a particular modification of the aforedescribed machine will now be described in conjunction with FIGS. 4–6. In this embodiment, elements which are common to the machine in FIG. 1 are designated by the same reference numerals. This embodiment differs from the one described earlier principally with respect to the construction of the wash drums and tanks as well as with respect to the piping within the machine.

Figure 4:
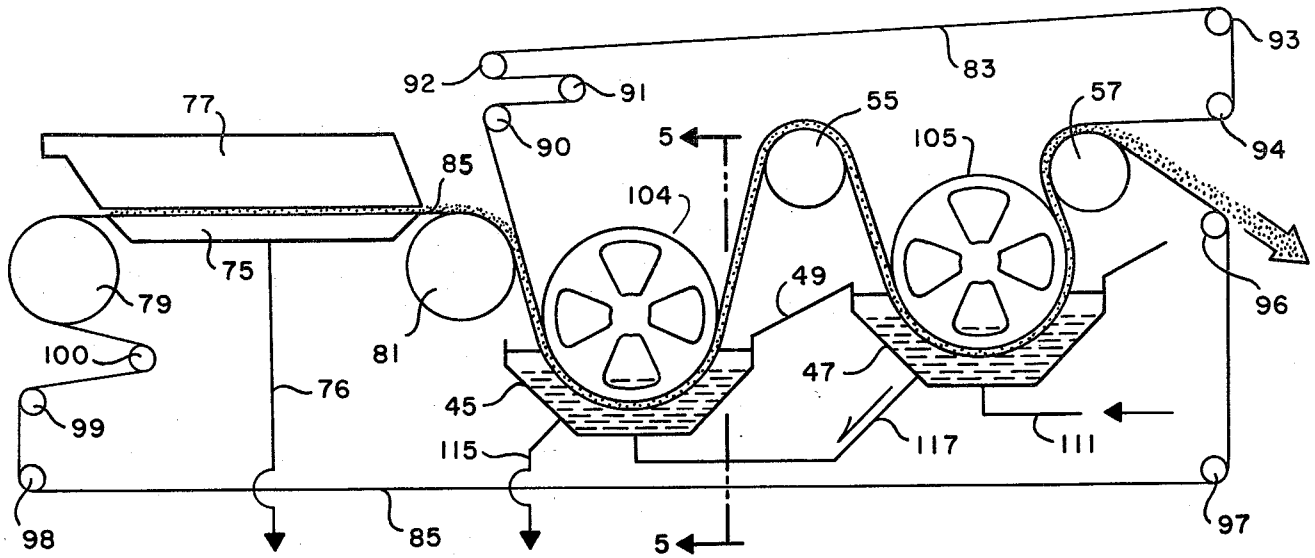
FIG. 4 is a side elevation of another embodiment of a machine according to the present invention.
Figure 5:
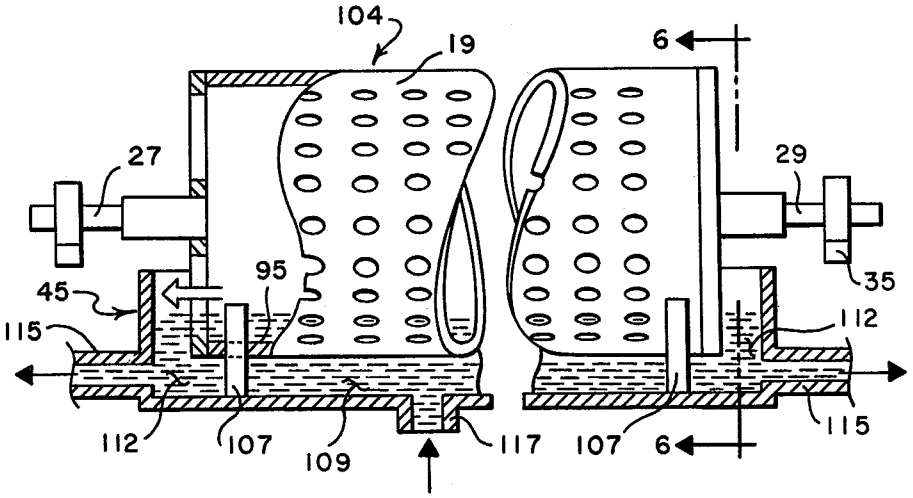
FIG. 5 is a view taken along line 5—5 in FIG. 4 which schematically shows a detail of the machine of FIG. 1 partially cut away.

As shown in FIG. 4, a machine according to this embodiment includes two wash cylinders 104 and 105 arranged to rotate in respective tanks 45 and 47 in the same fashion as the wash drums in the earlier-described embodiment. Here, however, the wash cylinders each have a least one open end, not two closed ends as had the aforedescribed wash drums. Thus, as shown by way of example in FIGS. 5–6, the wash cylinder 104 has a perforate sidewall 19 supported by rigid spokes 106 which extend radially from axle shafts 27 and 29. The spaces between the spokes are open, permitting liquid-flow communication between the associated tank 45 and the interior of the wash cylinder.

The machine in this embodiment further includes seal members 107 which are fixedly mounted in pairs in each of the tanks 45 and 47 near the ends of the wash cylinders. As can be best seen in FIGS. 5 and 6, each seal member is planar and has an arcuate edge portion which sealingly abuts the sidewall of the associated wash cylinder. Each seal member is fixed to extend from sidewall to sidewall of the associated tank across the tank floor. The function of the seal members is to partition the interior of each of the tanks into distinct zones. The zones defined between associated pairs of the seal members, herein referred to as wash spaces 109, are in liquid-flow communication with the interiors of the associated wash cylinders only via the openings in the cylindrical sidewalls. Pipe 111 is connected to the wash space 109 of tank 47 to introduce liquid thereinto.

A zone defined between a seal member 107 and the adjacent sidewall of the associated tank is herein referred to as discharge space 112. At least one such discharge space is provided in each of the tanks 45 and 47. (The wash cylinder 95 in FIG. 5 should be understood to have both of its end open and, therefore, there are two discharge spaces 112 provided in tank 45.) The discharge spaces are in direct flow communication with the interiors of the associated wash cylinders via the open ends of the cylinders. The discharge spaces 112, are of course, separated from the wash spaces 109 by the seal members 107. Connected in communication within the tank 45 is outlet conduit 115 which functions to withdraw liquid from discharge space 112. Pipe 117 is connected between the wash space 109 of tank 45 and the discharge space 112 of tank 47 to provide liquid flow therebetween.

Referring to FIG. 4, the outlet conduit 115 associated with the discharge space 112 in the first tank 45 is connected so that liquid drawn from the interior of the first wash cylinder 104 is carried to discharge. The outlet conduit 117 connected to the discharge space 112 in the second tank 47 is also connected to the wash space 109 of tank 45 so that liquid drawn from the interior of the second wash cylinder 105 is conveyed into the first tank 45.

The operation of the machine in FIG. 4 can now be understood with reference, for example, to wash cylinder 105 located in tank 47. Conduit 111 carries liquid into the wash space 109 of tank 47. Simultaneously, a pulp mat is carried between the endless belts 83 and 85 into the tank 47 and, with the belts, passes under the wash cylinder 105. From the wash space 109 in tank 47, liquid flows through the pulp mat into the wash cylinder 105. This flow is due to the hydrostatic head exterior of the wash cylinder exceeding the head within the wash cylinder. Liquid then flows through the open end of the wash cylinder 105 and into the discharge space 112. This liquid is then withdrawn from the discharge space 112 via the outlet conduit 117 and conveyed to tank 45.

I claim:

1. A machine for washing paper stock pulp and other free filtering materials comprising:

a. two or more horizontally-disposed wash drums each having a sidewall through which liquid can pass, said wash drums being mounted for rotation about their horizontal axes and disposed in side-by-side, vertically-stepped relationship with the first of said drums being the lowest and the last being the highest;

b. two or more open tanks mounted to encompass the lower parts of respective ones of said wash drums, said tanks being constructed to contain liquid exterior to said wash drums and being constructed so that liquid cannot flow directly from one tank to another so that each tank and drum cooperate to form a plurality of separate wash zones in vertically-stepped relationship with the first being the lowest and the last being the highest;

c. roller members mounted for rotation at spaced-apart locations above said wash drums;

d. first and second endless filter belts trained to pass under each of said wash drums and over each of said roller members in face-to-face relationship with each other to hold a mat of material to be washed;

e. a first set of guide means mounted above said wash drums to guide said first endless filter belt from the last of said wash drums to the first of said wash drums, and a second set of guide means mounted below said wash drums to guide said second endless filter belt from the last of said wash drums to the first of said wash drums;

f. drive means mounted to drive said first and second endless belts;

g. hydrostatic differential means connected in communication with each of said wash drums and each of said tanks to form a first body of liquid inside said drums and a second body of liquid inside said tanks and to provide a hydrostatic head differential between the first and second bodies of liquid to force the liquid through the material held between said first and second endless belts, thereby to wash the material; and, h. transfer means coupled to said hydrostatic differential means to transfer liquid from said last wash zone to a lower wash zone.

2. A machine for washing paper stock pulp and other free-filtering materials comprising:

a. two or more horizontally-disposed wash drum each having a perforated sidewall, and end closure walls, said wash drums being mounted for rotation about their horizontal axes and disposed in vertically-stepped relationship with the first of said drums being the lowest and the last being the highest;

b. two or more open tanks mounted and constructed to contain liquid exterior to said wash drums;

c. roller members mounted for rotation at spaced-apart locations above said wash drums;

d. first and second endless filter belts trained to pass under each of said wash drums and over each of said roller members in face-to-face relationship with each other;

e. a first set of guide means mounted for rotation above said wash drums to guide said first endless belt from the last of said wash drums to the first of said wash drums, and a second set of guide roller means mounted below said wash drums to guide said second endless belt from the last of said wash drums to the first of said wash drums;

f. drive means mounted to drive said first and second endless belts to travel under each of said wash drums and over each of said roller members;

g. liquid inlet means to introduce liquid directly into the interior of the highest of said wash drums; and h. outlet means connected in communication with each of said tanks to remove liquid from said tanks to provide a hydrostatic head differential between the interiors of said wash drums and the liquid contents of the associated said tanks thereby to force liquid from the wash drums into said tanks to wash the material held between said first and second endless belts.

3. A machine according to claim 2 wherein said outlet means comprises a vacuum receiver.

4. A machine according to claim 2 wherein the one of said outlet means which is connected to said highest tank is disposed to convey withdrawn liquid into one of said wash drums.

5. A machine according to claim 2 wherein at least one of said outlet means is connected to discharge withdrawn liquid into the wash drum which is associated with the next lower one of said tanks.

6. A machine according to claim 1 wherein said roller members each comprise a rigid, hollow cylinder formed from foraminous material which lets liquid drain freely through it.

7. A machine according to claim 1 further including means to adjustably position at least one of the guide means of said first set to thereby adjust the tension in said first endless belt.

8. A machine according to claim 1 further including feed means to form a mat of the material between said endless belts.

9. A machine according to claim 8 wherein said feed means includes (a) vacuum pan means mounted adjacent the lowermost one of said wash drums; (b) means mounted adjacent the ends of said vacuum pan means to guide said second endless filter belt to pass over said vacuum pan means; and (c) means to form a mat of pulp on the second endless filter belt.

10. A machine according to claim 1 including means to maintain said first belt at greater tension than said second belt so that a second compressive force is exerted upon the material held between the two belts when the belts pass over said roller members than when said belts pass under said wash drums.

11. A machine for washing paper stock pulp and other free-filtering materials comprising:

a. two or more horizontally-disposed wash cylinders each having a perforated sidewall and at least one open end, said wash cylinders being mounted for rotation about their horizontal axes and disposed in vertically-stepped relationship with the first of said wash cylinders being the lowest and the last being the highest;

b. open tanks mounted and constructed to contain liquid exterior to associated ones of said wash cylinders;

c. seal means mounted in each of said tanks to define in each of said tanks, a first zone contiguous with the perforated sidewall of the associated one of said wash cylinders and a second zone in liquid flow communication with said first zone only through the perforations in the sidewall of the associated said wash cylinder;

d. roller members mounted for rotation at spaced-apart locations above said wash cylinders;

e. first and second endless filter belts trained in face-to-face relationship with each other to pass alternatively under each of said wash cylinders and over each of said roller members;

f. a first set of guide means mounted for rotation above said wash cylinders to guide said first endless belt from the last of said wash cylinders to the first of said cylinders, and a second set of guide means mounted below said wash cylinders to guide said endless belt from the last of said wash cylinders to the first of said cylinders;

g. drive means mounted to drive said first and second endless belts to travel under each of said wash cylinders and over each of said roller members; and h. withdrawal means connected in communication with each of said second zones in each of said tanks to withdraw liquid from the interiors of said wash cylinders to provide a hydrostatic differential head between the interiors of said wash cylinders and the liquid contents of the associated said tank, thereby to force liquid through the belts and into said wash cylinders to wash the material held between said first and second endless belts.

12. A machine according to claim 11 wherein the one of said withdrawal means which is connected in association with said highest wash cylinder is disposed to discharge withdrawn liquid into the one of said tanks associated with the next lower one of said wash cylinders.

13. A machine according to claim 11 further including trough means which are mounted below said respective roller members to catch liquid drainage when said first and second endless drainage belts pass over said roller members.

14. A machine according to claim 11 wherein said first endless belt is at greater tension than said second belt so that a greater compressive force is exerted upon the material held between said two belts when the belts pass over said roller members than when said belts pass under said wash drums.

15. In a machine including two or more wash drums mounted in associated open tanks which contain liquid exterior of the wash drums, which drums have perforated sidewalls and are arranged in vertically-stepped relationship to one another, the first drum being the lowest and the last being the highest, and further including roller members mounted for rotation at spaced-apart locations above each of said wash drums, a method of washing paper stock pulp and other free-filtering materials comprising:

a. training an upper and a lower filter belt in face-to-face relationship to pass under each of said filter drums and over each of said roller members;

b. forming a mat of the material between the two belts;

c. driving the two belts to carry the mat of material under each of the drums and over each of the rollers from the first drum to the last drum;

d. introducing liquid into the interior of the last said drum to flow through the perforated sidewall of that drum and then through the mat into the tank associated with that drum, whereby the mat is washed by the liquid;

e. conveying without pumping, the once-used liquid from the tank associated with the last drum directly into the interior of a lower drum without flowing through the tank associated with said lower drum;

f. removing the washed mat of material from between the two belts after the belts have passed over the roller member associated with the last drum; and g. removing the liquid from the tank associated with the first drum.

16. The process of claim 15 further including the step of maintaining the upper belt at a higher tension than the lower belt.

17. The process of claim 15 further including the step of applying greater pressure to the mat of material as it passes over the rollers than as it passes under the drums in order to sequentially compress the mat and allow it to expand.

18. A machine according to claim 1 wherein said tanks are spaced apart from one another and have no means to convey liquid directly from one tank to another.

* * * * *